US005633702A

United States Patent [19]

Hayashi et al.

[11] Patent Number: 5,633,702

[45] Date of Patent: May 27, 1997

[54] TRANSFER MATERIAL CARRYING MEMBER AND IMAGE-FORMING APPARATUS COMPRISING SUCH TRANSFER MATERIAL CARRYING MEMBER

[75] Inventors: Yasuko Hayashi, Kawasaki; Katsumi Aoki, Yokohama, both of Japan

[73] Assignee: Canon Kabushiki Kaisha, Tokyo, Japan

[21] Appl. No.: 598,426

[22] Filed: Feb. 8, 1996

[30] Foreign Application Priority Data

Feb. 10, 1995 [JP] Japan ..... 7-046325

[51] Int. Cl.[6] ..... G03G 15/01; G03G 15/16

[52] U.S. Cl. ..... 399/316

[58] Field of Search ..... 355/271, 273, 355/274, 275, 326 R, 327

[56] References Cited

U.S. PATENT DOCUMENTS 5,172,172 12/1992 Amemiya et al. ..... 355/271

FOREIGN PATENT DOCUMENTS

| | | |
|---|---|---|
| 0578092 | 1/1994 | European Pat. Off. . |
| 0590584 | 4/1994 | European Pat. Off. . |
| 0603819 | 6/1994 | European Pat. Off. . |
| 0665476 | 8/1995 | European Pat. Off. . |
| 0676676 | 10/1995 | European Pat. Off. . |
| 5-204263 | 8/1992 | Japan . |

OTHER PUBLICATIONS

Patent Abstracts of Japan, vol. 017, No. 631 (P-1648), Nov. 22, 1993.

*Primary Examiner*—Joan H. Pendegrass

*Attorney, Agent, or Firm*—Fitzpatrick, Cella, Harper & Scinto

[57] ABSTRACT

A transfer material carrying member is described which has at least two resin-containing layers. The relative dielectric constant (E1) of the surface layer and the relative dielectric constant (E2) of the layer(s) other than the surface layer show a ratio (E1/E2) satisfying the following expression of $0.02 \leqq (E1/E2) \leqq 0.7$. The carrying member shows a high transfer efficiency and is able to provide high quality images for a prolonged period of time.

29 Claims, 4 Drawing Sheets

TRANSFER MATERIAL CARRYING MEMBER AND IMAGE-FORMING APPARATUS COMPRISING SUCH TRANSFER MATERIAL CARRYING MEMBER

BACKGROUND OF THE INVENTION

1. Field of the Invention

This invention relates to an image-forming apparatus based on an electrophotographic system or an electrostatic recording system and, more particularly, to an improved transfer material carrying member to be used for transferring a toner image formed on an image carrier onto a transfer material in such an image-forming apparatus. For the purpose of the present invention, an image-forming apparatus may be an electrophotographic copying machine, a printer or some other image recording apparatus that may be used for producing black and white images, monochromatic images and/or color images.

2. Related Background Art

In an image-forming apparatus operating on the basis of an electrophotographic system or an electrostatic recording system, a toner image formed on an image carrier is transferred onto a transfer material to produce a final image.

For example, in an electrophotographic apparatus involving a series of image forming operations of electrification, exposure to light, development, image transfer and cleaning typically comprises a transfer drum and a transfer unit illustrated in FIGS. 4 and 5 of the accompanying drawings and denoted by reference numeral 10 and 10A, respectively, in order to transfer a toner image formed on a photosensitive member 33 that operates as an image carrier onto a transfer material such as a sheet of paper.

Referring to FIG. 4, the transfer drum 10 comprises a support body formed by a pair of cylinders 12 and 13 arranged at the opposite ends of the drum and a connecting member 14 for connecting the cylinders and provided with a transfer material carrying member 11 covering an opening on the outer periphery of the support body. The connecting member 14 is provided with a gripper 15 for gripping the transfer material fed from a transfer material feeding unit. Additionally, as shown in FIG. 5, there are provided a transferring discharger 21, an inside diselectrifying discharger 23 and outside diselectrifying dischargers 22 and 24.

A transfer material is fed to the transfer drum 10 in synchronism with the formation of a toner image on the photosensitive member 33 and held onto the transfer drum 10 as it is gripped by the gripper 15 at the leading edge. Then, it is repeatedly made to pass through a transfer section disposed vis-a-vis the photosensitive member 33 as the transfer drum 10 rotates in the sense indicated by arrow a. Each time the transfer material passes through the transfer section, it is subjected to a corona discharge of the transferring discharger 21 from the back side of the transfer material carrying member 11 with a polarity opposite to that of the toner in order to transfer the toner image on the photosensitive member 33 onto the transfer material.

After receiving a required number of times of toner image transferring operations, the transfer material is diselectrified by the diselectrifying dischargers 22, 23 and 24, peeled off from the transfer drum 10 by means of a separation claw 28 and then moved to a fixing unit.

In order to obtain a high quality image, the toner image on the photosensitive member has to be accurately transferred onto the transfer material. In other words, a high transfer efficiency is required to achieve an enhanced degree of image quality for transferred images.

In order to improve the transfer efficiency, the toner on the photosensitive member has to be firmly and strongly attracted to the transfer material. Therefore, it is important to raise the intensity of the electric field applied to the transfer material and the transfer material carrying member as much as possible. In order to obtain a uniformly transferred image, it is important to make the transfer material carrying member free from electric leakage.

The above requirements can be effectively met by using a transfer material carrying member having a low relative dielectric constant. However, the use of a transfer material carrying member having a low relative dielectric constant can in turn lead to a problem of producing images with a low image density particularly when a large number of images are transferred continuously.

The above problem can become particularly remarkable when the developer contains fine particles of toner with a diameter less than 10 μm or an average particle diameter of about 8 μm, which are often used in recent years to improve the reproducibility of electrostatic latent images and hence the quality of final visible images.

SUMMARY OF THE INVENTION

In view of the above identified problem, it is therefore an object of the present invention to provide a transfer material carrying member that shows a high transfer efficiency and is securely free from electric leakage.

Another object of the present invention is to provide a transfer material carrying member that can provide high quality images if used repeatedly for a prolonged period of time.

Still another object of the present invention is to provide an image-forming apparatus comprising such a transfer material carrying member.

According to the invention, the above objects are achieved by providing a transfer material carrying member comprising at least two resin-containing layers, wherein the relative dielectric constant (E1) of the surface layer and the relative dielectric constant (E2) of the layer(s) other than the surface layer show a ratio (E1/E2) satisfying the following expression of $$0.02 \leqq (E1/E2) \leqq 0.7.$$

According to the invention, there is also provided an image-forming apparatus comprising a transfer material carrying member as described above.

DETAILED DESCRIPTION OF THE PREFERRED EMBODIMENTS

A transfer material carrying member according to the invention comprises at least two resin-containing layers, wherein the relative dielectric constant (E1) of the surface layer and the relative dielectric constant (E2) of the layer(s) other than the surface layer show a ratio (E1/E2) satisfying the following expression of:

$$0.02 \leqq (E1/E2) \leqq 0.7.$$

Figure 1:
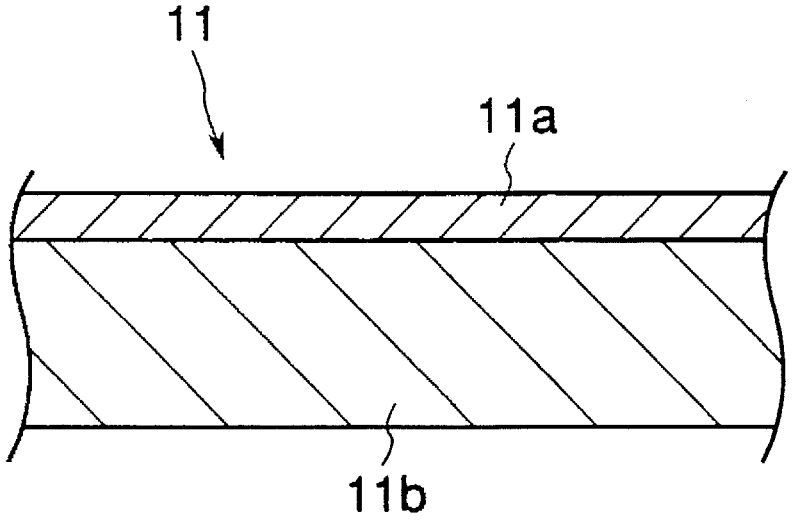
FIG. 1 is a schematic cross-sectional partial view of an embodiment of transfer material carrying member according to the invention.

FIG. 1 is a schematic cross-sectional view of an embodiment of transfer material carrying member according to the invention. Referring to FIG. 1, the embodiment of transfer material carrying member 11 comprises a surface layer 11*a* and one or more than one layer 11*b* other than the surface layer. For the purpose of the present invention, a surface layer refers to a layer that directly faces the image carrier or the transfer material in an image transfer operation. By definition, the one or more than one layer other than the surface layer refer to all the layer(s) other than the surface layer.

While the ratio of E1/E2 is not smaller than 0.02 but not greater than 0.7 for the purpose of the invention, it is preferably not smaller than 0.05 but not greater than 0.5. More preferably, it is not smaller than 0.05 but not greater than 0.4. If the ratio of E1/E2 exceeds 0.7, the transfer current is apt to leak away to give rise to a mottled image. If, on the other hand, the ratio of E1/E2 is less than of 0.02, the transfer material carrying member can show an accumulated electric charge due to the electric current discharged at the time of image transfer that hinders subsequent transfer of toner image in the course of repeated use of the transfer material carrying member.

For the purpose of the present invention, the surface layer 11*a* preferably has a relative dielectric constant E1 not smaller than 2.0 but not greater than 20, more preferably not smaller than 2.0 but not greater than 12. If the value of E1 is less than of 2.0, electric charge can be easily accumulated on the transfer material carrying member 11 by the electric current discharged at the time of image transfer operation and the accumulated electric charge hinders subsequent transfer of toner image in the course of repeated use of the transfer material carrying member. If, on the other hand, the value of E1 exceeds 20, the image carrier and the transfer material carrying member can be damaged by the leaked transfer current.

For the purpose of the present invention, the surface layer 11*a* preferably has a thickness not smaller than 0.5 μm but not greater than 50 μm, more preferably not smaller than 1 μm but not greater than 30 μm. If the surface layer has a thickness less than 0.5 μm, the intensity of electric field of the transfer material carrying member and the image carrier is apt to become undesirably low to adversely affect the quality of the produced image. If, on the other hand, the surface layer has a thickness exceeding 50 μm, the transfer material carrying member can show an accumulated electric charge due to the electric current discharged at the time of image transfer that hinders subsequent transfer of toner image in the course of repeated use of the transfer material carrying member.

For the purpose of the present invention, the surface layer 11*a* preferably has a volume resistivity of not smaller than $1\times10^{10}\Omega$cm but not greater than $1\times10^{18}\Omega$cm, more preferably not smaller than $1\times10^{12}\Omega$cm but not greater than $1\times10^{17}\Omega$cm. If the surface layer has a volume resistivity less than $1\times10^{10}\Omega$cm, defective image transfer can take place because the electric charge can flow out. If, on the other hand, the surface layer has a volume resistivity exceeding $1\times10^{18}\Omega$cm, the transfer material carrying member can show an accumulated electric charge that gives rise to defective image transfer in the course of repeated use of the transfer material carrying member.

For the purpose of the present invention, the resin contained in the surface layer 11*a* may be of any type. Preferable resins that can be used for the purpose of the invention include polyester type resins such as polyethyleneterephthalate, polybutyleneterephthalate and polethylenenaphthalate, polyamide type resins such as nylon 66, solvent-soluble type polyimide resins, thermoplastic resins such as high density polyethylene and copolymeric resins such as styrene-butadiene copolymer. Any of these thermoplastic resins shows good wear-resistance and hence can advantageously provide good image quality for a prolonged period of time. However, any of appropriate thermosetting resins may also be used to form the surface layer.

For the purpose of the present invention, the surface layer 11*a* preferably shows an abrasion-resistance, or rate of abrasion, of not greater than 7.0 mg/1,000 revolutions. To determine this rate of abrasion, an abrasion test using an abrasion wheel was conducted in accordance with the procedure defined by JIS K-7204, and the weight (g) lost by abrasion was measured as a wrapping tape containing aluminum oxide (alumina) was applied to the wheel.

For the purpose of the present invention, the layer(s) 11*b* other than the surface layer (or the underlayer) preferably has (have) a relative dielectric constant E2 not smaller than 2.5 but not greater than 150, more preferably not smaller than 7 but not greater than 100. If the value of E2 of the underlayer is less than 2.5, electric charge can be easily accumulated on the transfer material carrying member 11 by the electric current discharged at the time of image transfer operation, and the accumulated electric charge hinders subsequent transfer of toner image in the course of repeated use of the transfer material carrying member. If, on the other hand, the value of E2 exceeds 150, defective image transfer can take place because the electric charge can be retained with difficulty.

For the purpose of the present invention, the layer(s) 11*b* other than the surface layer preferably has (have) a thickness not smaller than 50 μm but not greater than 800 μm. If the layer(s) has (have) a thickness short of 50 μm, it can show an irrelevantly low mechanical strength and hardly hold the electric charge particularly when its relative dielectric constant is high. If, on the other hand, the layer(s) has (have) a thickness exceeding 800 μm, it is apt to show an excessively accumulated electric charge particularly when its relative dielectric constant is low.

For the purpose of the present invention, the layer(s) 11*b* other than the surface layer preferably has (have) a volume resistivity of not smaller than $1\times10^{5}\Omega$cm but not greater than $1\times10^{17}\Omega$cm, more preferably not smaller than $1\times10^{7}\Omega$cm but not greater than $1\times10^{15}\Omega$cm. If the layer(s) has (have) a volume resistivity less than $1\times10^{5}\Omega$cm, defective image transfer can take place because the electric charge can flow out. If, on the other hand, the layer(s) has (have) a volume resistivity exceeding $1\times10^{17}\Omega$cm, the transfer material carrying member can show an accumulated electric charge.

For the purpose of the present invention, the resin contained in the layer(s) 11*b* other than the surface layer may be of any type. Preferable resins that can be used for the purpose of the invention include resins such as polycarbonate, polyarylate, polyvinylidenefluoride, polyethylene, polypropylene polyester, polyurethane and silicon resin, copolymers and alloys of any of these.

If desired, any of known additives may be added to any or all of the layers in the invention. Additives that can be used for the purpose of the invention include reinforcing agents, anti-oxidants, bulking agents, stabilizing agents, ultraviolet rays absorbing agents, lubricants, release agents, dyes, pigments, flame retardants and impact-resistance improving elastomers. For example, phosphorous acid or phosphite is most preferably be used as stabilizing agent. Suitable release agents for the purpose of the invention include monomers of saturated fatty acids and esters of polyhydric alcohols such as stearyl stearate and dipentaerythritolhexaoctoate. Resins of ordinary polycarbonate, polyestercarbonate and polyarylate may suitably be used depending on applications.

For the purpose of the present invention, one or more than one electroconductive agent may be dispersed into any or all of the layers in order to control the transfer current. Electroconductive agents that can be used for the purpose of the invention include electroconductive carbon black and electroconductive metal oxides such as electrocondcutive titanium oxide and electroconductive indium oxide.

For the purpose of the present invention, the transfer material carrying member 11 may be prepared from resin by means of extrusion molding, injection molding or some other molding technique. The transfer material carrying member preferably shows a volume resistivity between $1\times10^{8}\Omega$cm and $1\times10^{17}\Omega$cm and a relative dielectric constant E not smaller than 3.0. The transfer material carrying member may take the form of a sheet or an endless belt or any other form suited for the transfer unit with which the transfer material carrying member is used. An endless belt may be prepared by fusion-bonding a pair of opposite ends of a sheet by means of heat, an ultrasonic wave or an adhesive agent. While the total thickness of the transfer material carrying member may vary depending on the volume resistivity and the relative dielectric constant of the member, it is preferably between 50 μm and 800 μm and more preferably between 70 μm and 300 μm.

For the purpose of the present invention, the relative dielectric constant of the transfer material carrying member may suitably be determined by means of an impedance analyzer 4192 ALF (trade name available from Yokogawa Hewlett-Packard) and by forming a pair of gold electrodes to a diameter of 50 mm respectively on the upper and lower surfaces of a specimen by vapor deposition and applying an inter-peak voltage of 1 V with a frequency of 10 kHz (23° C., 55% RH).

The thickness of the transfer material carrying member may suitably be determined by means of a dial gauge 2109-10 (trade name available from Mitsutoyo).

The volume resistivity of the transfer material carrying member may suitably be determined by means of a digital ultra-high ohmmeter R8340A (trade name available from Advantest) and by applying a DC voltage of 500 V for a minute to a specimen similar to the one used for determining the relative dielectric constant.

An image-forming apparatus according to the invention comprises an image carrier, an electrifying means, a developing means and a transferring means including a transfer material carrying member according to the invention.

For the purpose of the present invention, the image carrier, the electrifying means and the developing means may be selected from any known such devices.

For the purpose of the invention, sheets of paper, OHP sheets and other transfer materials may be utilized.

Figure 2:
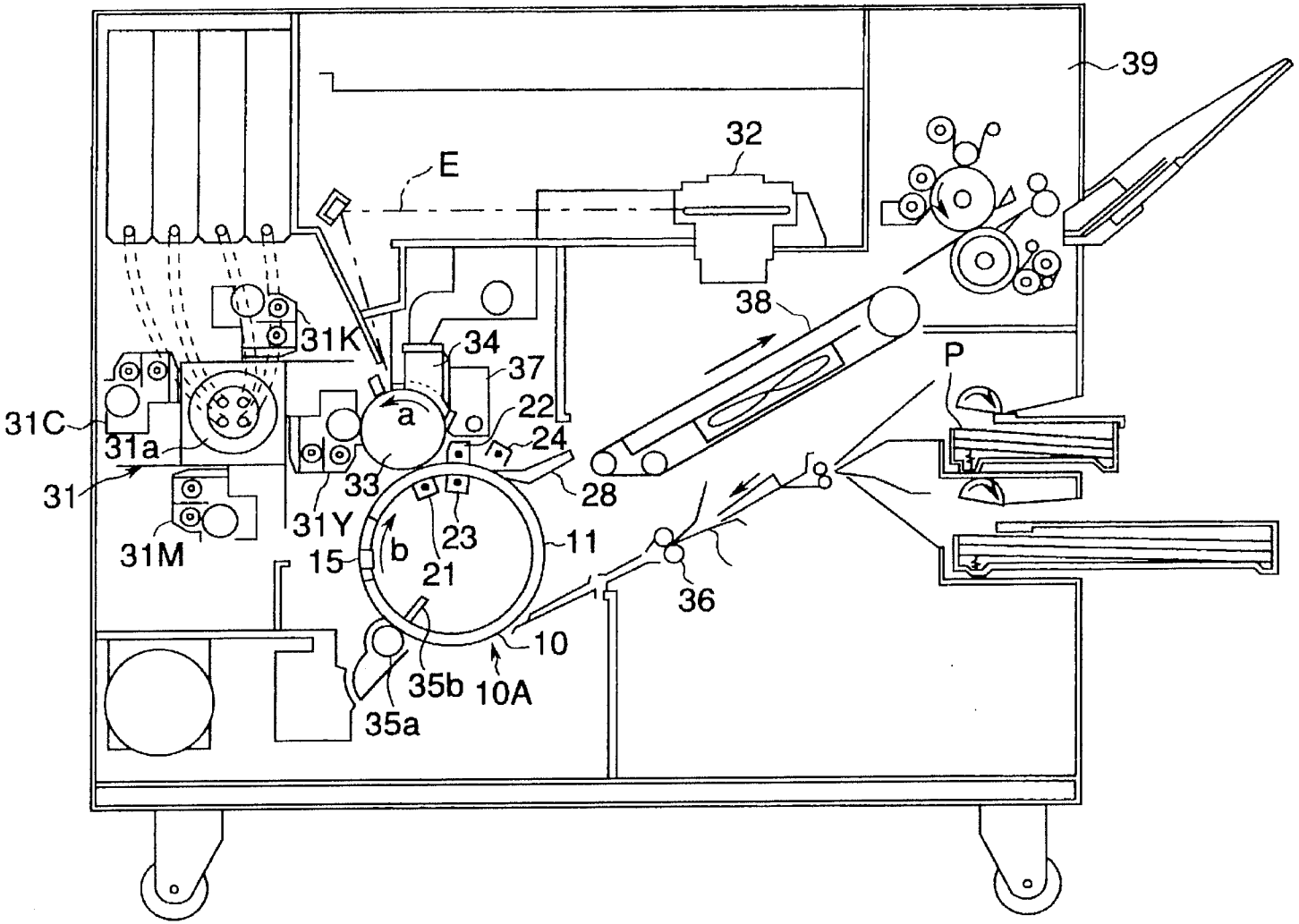
FIG. 2 is a schematic lateral view of an embodiment of image-forming apparatus according to the invention.

Now, an image-forming apparatus according to the invention will be described in detail. FIG. 2 is a schematic lateral view of an embodiment of image-forming apparatus according to the invention. The image-forming apparatus of FIG. 2 is a multi-color electrophotographic apparatus comprising a transfer unit 10A provided with a transfer drum 10, in which a transfer material carrying member according to the invention is used.

This embodiment of multi-color electrophotographic apparatus additionally comprises a photosensitive member 33 that operates as an image carrier and rotates in the direction as indicated by arrow a. Along the outer periphery of the photosensitive member 33, there is provided an image-forming means comprising a primary electrifier 34 for uniformly electrifying the photosensitive member 33, an exposing means 32 that may typically be a laser beam exposure unit for irradiating the photosensitive member 33 with a flux of light corresponding to an optical image E that has undergone color separation to form an electrostatic latent image on the photosensitive member 33 and a rotary developing unit 31 for developing the electrostatic latent image on the photosensitive member 33.

The rotary developing unit 31 by turn comprises four developing devices 31Y, 31M, 31C and 31K containing therein developing agents of yellow, magenta, cyan and black, respectively and a substantially cylindrical rotary cabinet 31*a* housing the developing devices 31Y, 31M, 31C and 31K. The developing unit 31 brings a necessary one of the developing devices at a time to a developing site disposed vis-a-vis the outer peripheral surface of the photosensitive member 33 by rotating the cabinet 31*a* to develop the latent image on the photosensitive member 33 so that, as a whole, it can develop an image in the four colors.

In short, the photosensitive member 33 is electrified by the primary electrifier 34 and a latent image is formed thereon as it is irradiated with a flux of light corresponding to an optical image E using the exposing means 32 and then developed by means of the developing unit 31 to produce on the photosensitive member 33 a toner image of toner containing resin particles with an average particle diameter between 8 μm and 12 μm. This developing operation is repeated for four colors of yellow, magenta, cyan and black.

Meanwhile, in synchronism with the operation of forming an image on the photosensitive member 33, a transfer material P is fed to the transfer drum 10 of the transfer unit 10A by means of a registration roller 36. The transfer material P is firmly held at the leading edge thereof by a gripper 15 of the transfer drum 10 and moved to the transfer section disposed vis-a-vis the photosensitive member 33 as the transfer drum 10 rotates in the direction indicated by arrow b. When the transfer material P gets to the transfer section, it is subjected to a corona discharge of the transferring discharger 23 from the back side of the transfer material carrying member 11 with a polarity opposite to that of the toner and the toner image on the photosensitive member 33 is transferred onto the transfer material P. Note that this operation of moving the transfer material P by means of the transfer drum 10 and transferring the toner image in the transfer section is repeated for each of the four colors so that a color image composed of four colors of yellow, magenta, cyan and black is formed on the transfer material P.

Thereafter, the transfer material P is peeled off from the transfer drum 10 by means of a separation claw 28 while it is being diselectrified by the diselectrifying dischargers 22, 23 and 24, and then moved to a fixing unit 39 by means of a transporting belt 38, where the image is thermally fixed to become a durable full color image before it is delivered to the outside of the electrophotographic apparatus.

On the other hand, the photosensitive member 33 is cleaned of the toner remaining on the surface thereof by a cleaning unit 37 to make itself ready for the next image forming operation. The surface of the transfer material carrying member 11 of the transfer drum 10 is also cleaned by another cleaning unit 35*a* typically comprising a blade and a fur brush and an auxiliary cleaning means 35*b* to make itself ready for the next image forming operation.

Figure 5:
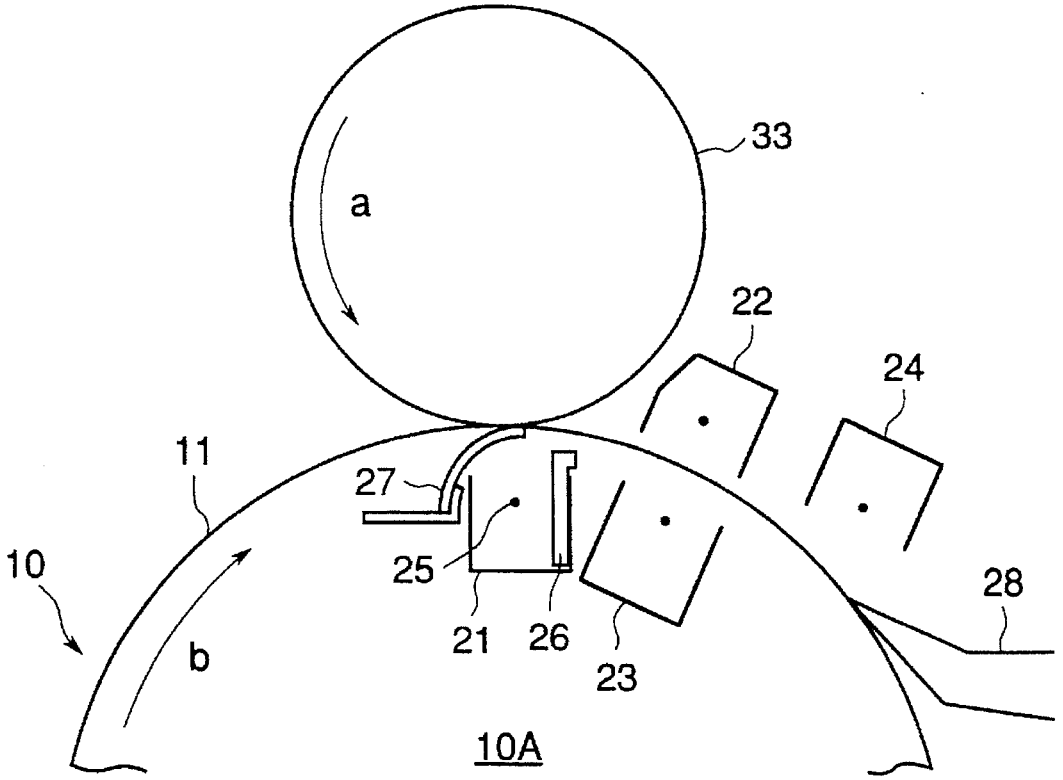
FIG. 5 is a schematic cross sectional view of an image transfer section of a transfer unit of an image-forming apparatus of the type under consideration.

For the purpose of the invention, the image-transferring corona discharger 21 is preferably provided with an insulation member 26, which is typically a shield panel of polycarbonate resin arranged downstream in the direction of rotation (as indicated by arrow b) of the transfer drum 10 as shown in FIG. 5 so that the discharged image-transferring corona may be maximally directed to the photosensitive member 33.

The image-transferring corona discharger 21 may be additionally provided with an elastic urging member 27 extending from the upstream to the downstream of the transfer material carrying member 11 to urge the transfer material carrying member 11 from the back side. Preferably, this urging member is made of resin film of polyethylene, polypropylene, polyester or polyethyleneterephthalate having a volume resistivity not smaller than $10^{10}\Omega$cm, preferably not smaller than $10^{14}\Omega$cm and covers the entire transfer section.

Figure 3:
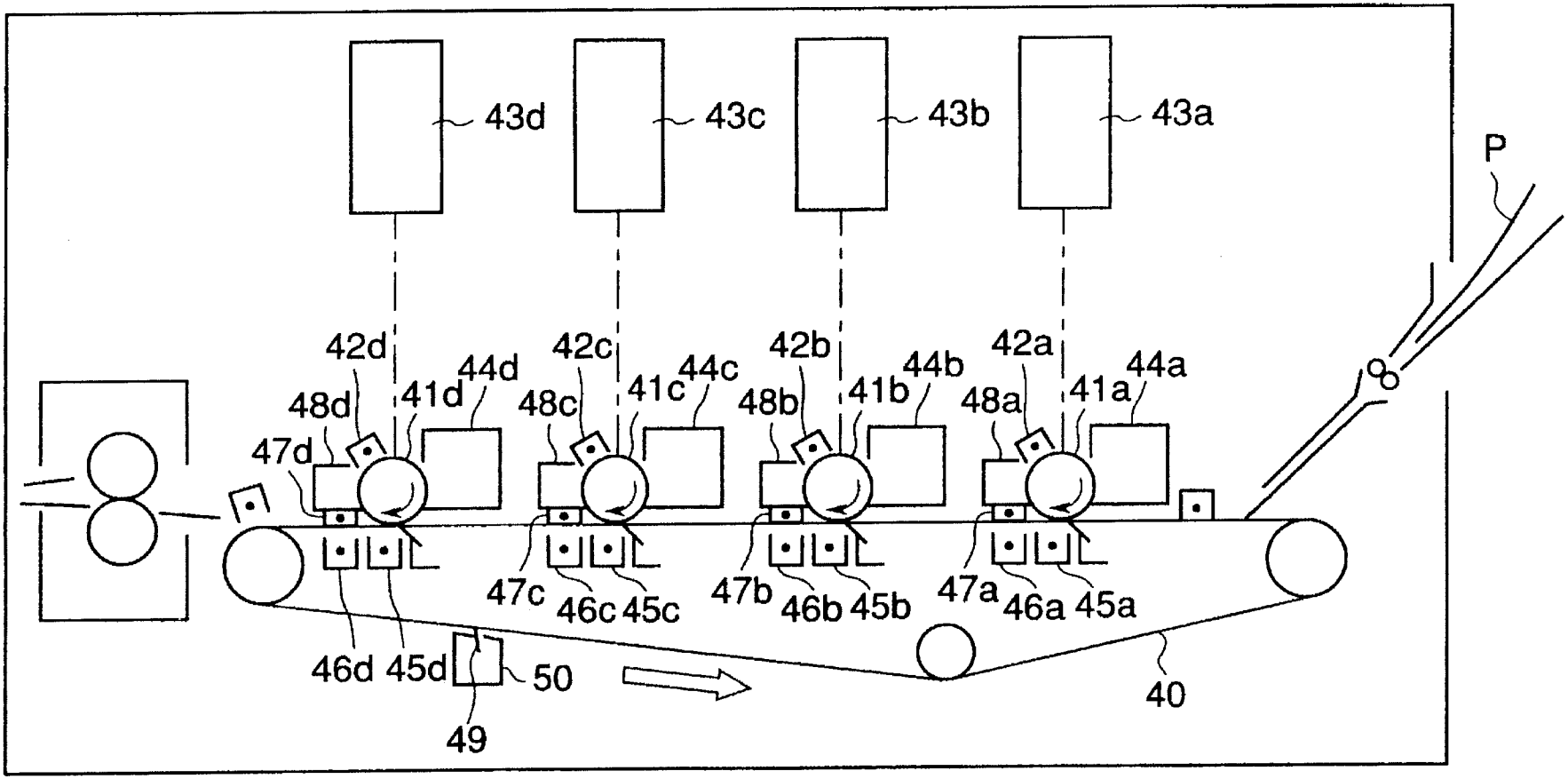
FIG. 3 is a schematic lateral view of another embodiment of image-forming apparatus according to the invention.

FIG. 3 is a schematic lateral view of another embodiment of image-forming apparatus according to the invention. The transfer material carrying member of this embodiment is realized in the form of an endless transfer belt 40.

This embodiment comprises horizontally and linearly arranged photosensitive members 41*a*, 41*b*, 41*c* and 41*d*, around which there are respectively arranged primary electrifiers 42*a*, 42*b*, 42*c* and 42*d*, exposing means 43*a*, 43*b*, 43*c* and 43*d*, developing units 44*a*, 44*b*, 44*c* and 44*d*, image-transferring dischargers 45*a*, 45*b*, 45*c* and 45*d*, diselectrifying dischargers 46*a*, 46*b*, 46*c*, 46*d*, 47*a*, 47*b*, 47*c* and 47*d* and cleaning units 48*d*, 48*b*, 48*c* and 48*d* to form four image-forming assemblies for the four different colors.

An image of a single color is formed on each of the photosensitive members 41*a*, 41*b*, 41*c* and 41*d* by a corresponding one of the assemblies. The procedure with which a toner image is formed is similar to the one described above by referring to the first embodiment.

The transfer material carrying member of this embodiment realized in the form of an endless transfer belt 40 is so arranged as to run through the assemblies at positions under the photosensitive members 41*a*, 41*b*, 41*c* and 41*d*. A belt cleaning unit 50 comprising an urethane blade 49 is arranged near the lower half of the track of the transfer belt 40.

The transfer material P is fed onto the transfer belt 40 by a feeding roller and then sequentially moved to the transfer sections of the assemblies disposed vis-a-vis the respective photosensitive members 41*a*, 41*b*, 41*c* and 41*d*, form which the respective toner images of the four different colors are sequentially transferred on it to produce a final full color image.

Now, the present invention will be described by way of examples, although these examples do not limit the scope of the present invention by any means.

EXAMPLE 1

Carbon black (8 wt %) was added to polycarbonate resin (Iupilon S-2000 (trade name: available from Mitsubishi Gas Chemical), viscosity average molecular weight: 25,000) and mixed well with the latter in a tumbler. The mixture was then pelletized by means of a biaxial extruder having a vent and the obtained pellets were molten at 240° C. along with polyethyleneterephthalate. A transfer material carrying member of a double-layered structure having an 8 μm thick surface layer of polyethyleneterephthalate and a 150 μm thick underlayer of a mixture of polycarbonate and carbon black was produced by co-extrusion molding.

The relative dielectric constant (E1) and the volume resistivity of the surface layer and the relative dielectric constant (E2) and the volume resistivity of the underlayer were determined.

Figure 4:
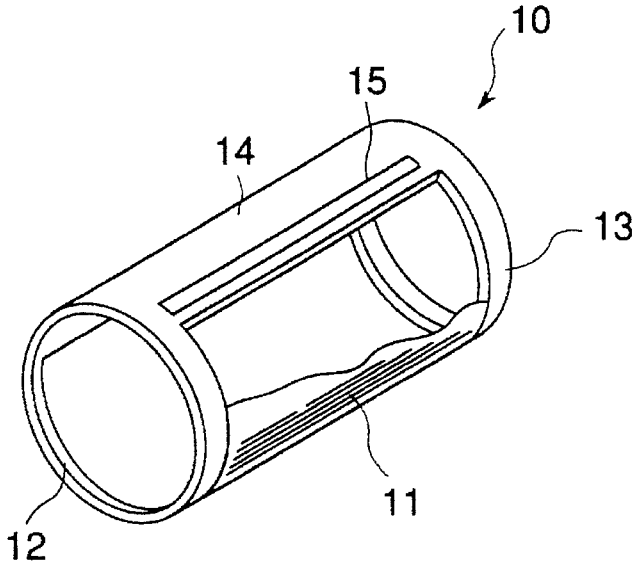
FIG. 4 is a schematic perspective view of a transfer drum that can be used for a transfer unit of an image-forming apparatus of the type under consideration.

Then, the obtained transfer material carrying member 11 was put to cover the opening of the support body of the transfer drum as shown in FIG. 4 and a pair of opposite edges of the transfer material carrying member 11 were secured to the connecting member 14 connecting aluminum cylinders 12 and 13 to complete the transfer drum 10 having a diameter of 160 mm.

The transfer drum 10 was then set in position in the image-forming apparatus of FIG. 2 and used to transfer a toner image on the photosensitive member 33 onto the transfer material by rotating it at a surface rotary speed of 160 mm/sec. The opening of the image-transferring corona discharger 21 was 19 mm and the distance separating the discharge wire 25 and the outer peripheral surface of the photosensitive member 33 and the distance separating the discharge wire 25 and the bottom of the shield panel of the image-transferring corona discharger 21 were 10.5 mm and 16 mm respectively. Film of polyethyleneterephthalate resin was used for the urging member 27.

An image was formed on the photosensitive member 33 by electrifying the photosensitive member 33 to negative polarity, forming an electrostatic latent image on the photosensitive member 33 and then reversely developing the latent image by means of toner with an average particle size of 8 μm. The toner contained resin, a coloring agent and additives to small concentrations in order to better control the state of electrification and improve the lubricity of the photosensitive member and was designed to become electrified to negative polarity by friction with carrier particles in the developing vessel.

After forming toner images of the four colors, the transfer material was separated from the transfer drum 10 and fixed in the fixing unit. The surface of the transfer material carrying member 11 was cleaned by the cleaning unit 35*a* having an urethane blade and the auxiliary cleaning means 35*b*.

A total of 100,000 full color images were continuously formed by means of the above arrangement and the obtained images were visually evaluated. Table 1 summarizes the obtained results. As seen from Table 1, mottle-free high quality images were obtained not only in the initial stages but also after continuous 100,000 runs of producing images. As shown in Table 1, the image quality was rated by ⊙—excellent, ○—good, Δ—permissible and X—no good.

The rate of abrasion of the transfer material carrying member was determined by the method described earlier. The results are also shown in Table 1.

EXAMPLE 2

A double-layered transfer material carrying member the same as that of Example 1 was prepared in a manner as described above by referring to Example 1 except that polybutyleneterephthalate was used in place of polyethyleneterephthalate and the surface layer had a thickness of 1.5 μm. The sample was then tested as that of Example 1 to obtain satisfactory results similarly to Example 1 summarized in Table 1.

EXAMPLE 3

A double-layered transfer material carrying member the same as that of Example 1 was prepared in a manner as described above by referring to Example 1 except that the surface layer was formed by bringing molten high density polyethylene into contact with the surface of the underlayer at 160° C. by applying pressure thereto. The prepared sample of transfer material carrying member was then tested as that of Example 1 to obtain satisfactory results similarly to Example 1 summarized in Table 1.

EXAMPLE 4

A double-layered transfer material carrying member the same as that of Example 1 was prepared in a manner as described above by referring to Example 1 except that the surface layer was formed by applying a 10% toluene solution of copolymeric resin of polymethylmethacrylate and polystyrene to the surface of the underlayer and drying the solution. The prepared sample of transfer material carrying member was then tested as that of Example 1 to obtain satisfactory results summarized in Table 1.

EXAMPLE 5

A double-layered transfer material carrying member the same as that of Example 1 was prepared in a manner as described above by referring to Example 1 except that the surface layer was formed by applying a 10% toluene solution of copolymeric resin of styrene-butadiene to the surface of the underlayer and drying the solution. The prepared sample of transfer material carrying member was then tested as that of Example 1 to obtain satisfactory results similarly to Example 1 summarized in Table 1.

EXAMPLE 6

A double-layered transfer material carrying member the same as that of Example 1 was prepared in a manner as described above by referring to Example 1 except that the surface layer was formed by applying an N-methylpyrrolidone solution containing polyimide to the surface of the underlayer and baking the applied layer at 120° C. The prepared sample of transfer material carrying member was then tested as that of Example 1 to obtain satisfactory results similarly to Example 1 summarized in Table 1.

EXAMPLE 7

A triple-layered transfer material carrying member was prepared by applying a 35% methylcellosolve solution containing epoxy resin to the surface of the underlayer, drying it and then bonding polyethyleneterephthalate film thereto at 120° C. under pressure for two hours. The prepared sample of transfer material carrying member was then tested as that of Example 1 to obtain satisfactory results similarly to Example 1 summarized in Table 1.

EXAMPLE 8

A transfer material carrying member same as that of Example 1 was prepared in a manner as described above by referring to Example 1 except that carbon black was used in an amount of 15 wt %. The prepared sample of transfer material carrying member was then tested. The obtained results are summarized in Table 1.

EXAMPLE 9

A transfer material carrying member same as that of Example 1 was prepared in a manner as described above by referring to Example 1 except that carbon black was added by 10 wt % and that the underlayer was made as thick as 200 μm and the surface layer was a polyvinylidene fluoride layer having a thickness of 10 μm. The prepared sample of transfer material carrying member was then tested. The obtained results are summarized in Table 1.

EXAMPLE 10

A transfer material carrying member same as that of Example 1 was prepared in a manner as described above by referring to Example 1 except that the surface layer was made as thick as 60 μm. The prepared sample of transfer material carrying member was then tested. The obtained results are summarized in Table 1.

EXAMPLE 11

A transfer material carrying member same as that of Example 1 was prepared in a manner as described above by referring to Example 1 except that the surface layer was made to have a thickness of 0.3 μm. The prepared sample of transfer material carrying member was then tested. The obtained results are summarized in Table 1.

COMPARATIVE EXAMPLE 1

A transfer material carrying member same as that of Example 1 was prepared in a manner as described above by referring to Example 1 except that no surface layer was formed. The prepared sample of transfer material carrying member was then tested. The obtained results are summarized in Table 1.

As seen from Table 1, after 60,000 continuous runs of producing images, the transfer material carrying member showed a large number of scars on the surface, and partially mottled images were formed.

COMPARATIVE EXAMPLE 2

A transfer material carrying member same as that of Example 1 was prepared in a manner as described above by referring to Example 1 except that carbon black was added by 25 wt % and that the underlayer was made to have a thickness of 120 μm. The prepared sample of transfer material carrying member was then tested. The obtained results are summarized in Table 1.

COMPARATIVE EXAMPLE 3

A transfer material carrying member same as that of Example 1 was prepared in a manner as described above by referring to Example 1 except that the surface layer was made of polyvinylidene fluoride. The prepared sample of transfer material carrying member was then tested. The obtained results are summarized in Table 1.

TABLE 1

| | Surface layer | | | Underlayer | | | | Entire transfer material carrying member | | | Image quality | | Rate of |
|---|---|---|---|---|---|---|---|---|---|---|---|---|---|
| | E1 | Film thickness (μm) | Volume resistivity (Ω · cm) | E2 | Film thickness (μm) | Volume resistivity (Ω · cm) | E1/E2 | E | Film thickness (μm) | Volume resistivity (Ω · cm) | Initial | After test runs | abrasion (mg/1000 r) |
| Example 1 | 2.32 | 8.0 | 2.0E+17 | 9.75 | 150.0 | 6.6E+12 | 0.24 | 8.39 | 158.0 | 1.0E+16 | ◎ | ◎ | 0.16 |
| Example 2 | 2.43 | 1.5 | 1.0E+17 | 9.75 | 150.0 | 6.6E+12 | 0.25 | 9.47 | 151.5 | 1.0E+15 | ◎ | ◎ | 0.20 |
| Example 3 | 2.28 | 1.5 | 4.2E+17 | 9.75 | 150.0 | 6.6E+12 | 0.23 | 9.44 | 151.5 | 4.2E+15 | ◎ | ◎ | 0.14 |
| Example 4 | 2.63 | 2.0 | 5.3E+16 | 9.75 | 150.0 | 6.6E+12 | 0.27 | 9.41 | 152.0 | 7.0E+14 | ◎ | ◎ | 4.44 |
| Example 5 | 2.28 | 2.0 | 1.5E+17 | 9.75 | 150.0 | 6.6E+12 | 0.23 | 9.35 | 152.0 | 2.0E+15 | ◎ | ◎ | 5.86 |
| Example 6 | 2.31 | 2.0 | 7.0E+17 | 9.75 | 150.0 | 6.6E+12 | 0.24 | 9.35 | 152.0 | 9.2E+15 | ◎ | ◎ | 1.34 |
| Example 7 | 2.32 | 2.0 | 2.0E+17 | 9.33 | 152.0 | 1.3E+14 | 0.25 | 8.98 | 154.0 | 2.7E+15 | ◎ | ◎ | 0.18 |
| Example 8 | 2.32 | 8.0 | 2.0E+17 | 58.3 | 150.0 | 2.7E+09 | 0.04 | 26.24 | 158.0 | 1.0E+16 | ○ | ○ | 0.16 |
| Example 9 | 10.5 | 10.0 | 5.3E+14 | 16.2 | 200.0 | 4.8E+10 | 0.65 | 15.79 | 210.0 | 2.5E+13 | ○ | ○ | 0.52 |
| Example 10 | 2.32 | 60.0 | 2.0E+17 | 9.75 | 150.0 | 6.6E+12 | 0.24 | 5.09 | 210.0 | 5.7E+16 | Δ | Δ | 0.17 |
| Example 11 | 2.32 | 0.3 | 2.0E+17 | 9.75 | 150.0 | 6.6E+12 | 0.24 | 9.69 | 150.3 | 4.1E+14 | ○ | Δ | 0.16 |
| Comparative 1 | — | — | — | 9.75 | 150.0 | 6.6E+12 | — | 9.75 | 150.0 | 6.6E+12 | x | x | 7.59 |
| Comparative 2 | 2.32 | 8.0 | 2.0E+17 | 180.5 | 120.0 | 8.3E+08 | 0.01 | 31.12 | 128.0 | 1.3E+16 | x | x | 0.15 |
| Comparative 3 | 10.5 | 8.0 | 5.3E+14 | 9.75 | 150.0 | 6.6E+12 | 1.08 | 9.79 | 158.0 | 3.3E+13 | x | x | 0.51 |

Note:
"E+12" etc. mean "$\times 10^{12}$" etc.
"Underlayer" means the layer(s) other then the surface layer.

What is claimed is:

1. A transfer material carrying member comprising at least two resin-containing layers, wherein the relative dielectric constant (E1) of the surface layer and the relative dielectric constant (E2) of the layer(s) other than the surface layer show a ratio (E1/E2) satisfying the following expression of $$0.02 \leqq (E1/E2) \leqq 0.7.$$

2. A transfer material carrying member according to claim 1, wherein the ratio (E1/E2) is not smaller than 0.05 but not greater than 0.5.

3. A transfer material carrying member according to claim 1, wherein the ratio (E1/E2) is not smaller than 0.05 but not greater than 0.4.

4. A transfer material carrying member according to claim 1, wherein the E1 is not smaller than 2.0.

5. A transfer material carrying member according to claim 1 or 4, wherein the E1 is not greater than 20.

6. A transfer material carrying member according to claim 1, wherein the surface layer has a thickness not smaller than 0.5 μm.

7. A transfer material carrying member according to claim 1 or 6, wherein the surface layer has a thickness not greater than 50 μm.

8. A transfer material carrying member according to claim 1, wherein the surface layer has a volume resistivity between $10^{10}$Ωcm and $10^{18}$Ωcm.

9. A transfer material carrying member according to claim 1, wherein the surface layer has a rate of abrasion of not greater than 7.0 mg/1,000 revolutions.

10. A transfer material carrying member according to claim 1, wherein the E2 is not smaller than 2.5.

11. A transfer material carrying member according to claim 1 or 10, wherein the E2 is not greater than 150.

12. A transfer material carrying member according to claim 1, wherein the thickness of the layer(s) other than the surface layer is not smaller than 50 μm.

13. A transfer material carrying member according to claim 1 or 12, wherein the thickness of the layer(s) other than the surface layer is not greater than 800 μm.

14. A transfer material carrying member according to claim 1, wherein the volume resistivity of the layer(s) other than the surface layer is between $10^{5}$Ωcm and $10^{17}$Ωcm.

15. An image-forming apparatus comprising an image carrier, an electrifying means, a developing means and a transferring means, wherein said transferring means has a transfer material carrying member, which transfer material carrying member comprises at least two resin-containing layers, the relative dielectric constant (E1) of the surface layer and the relative dielectric constant (E2) of the layer(s) other than the surface layer showing a ratio (E1/E2) satisfying the following expression of $$0.02 \leqq (E1/E2) \leqq 0.7.$$

16. An image-forming apparatus according to claim 15, wherein the ratio (E1/E2) is not smaller than 0.05 but not greater than 0.5.

17. An image-forming apparatus according to claim 15, wherein the ratio (E1/E2) is not smaller than 0.05 but not greater than 0.4.

18. An image-forming apparatus according to claim 15, wherein the E1 is not smaller than 2.0.

19. An image-forming apparatus according to claim 15 or 18, wherein the E1 is not greater than 20.

20. An image-forming apparatus according to claim 15, wherein the surface layer has a thickness not smaller than 0.5 μm.

21. An image-forming apparatus according to claim 15 or 20, wherein the surface layer has a thickness not greater than 50 μm.

22. An image-forming apparatus according to claim 15, wherein the surface layer has a volume resistivity between $10^{10}\Omega$cm and $10^{18}\Omega$cm.

23. An image-forming apparatus according to claim 15, wherein the surface layer has a rate of abrasion of not greater than 7.0 mg/1,000 revolutions.

24. An image-forming apparatus according to claim 15, wherein the E2 is not smaller than 2.5.

25. An image-forming apparatus according to claim 15 or 24, wherein the E2 is not greater than 150.

26. An image-forming apparatus according to claim 15, wherein the thickness of the layer(s) other than the surface layer is not smaller than 50 μm.

27. An image-forming apparatus according to claim 15 or 26, wherein the thickness of the layer(s) other than the surface layer is not greater than 800 μm.

28. An image-forming apparatus according to claim 15, wherein the volume resistivity of the layer(s) other than the surface layer is between $10^{5}\Omega$cm and $10^{17}\Omega$cm.

29. An image-forming apparatus according to claim 15, wherein the image carrier is an electrophotographic photosensitive member.

* * * * *

UNITED STATES PATENT AND TRADEMARK OFFICE

CERTIFICATE OF CORRECTION

PATENT NO. : 5,633,702

DATED : May 27, 1997

INVENTOR(S) : YASUKO HAYASHI, ET AL.

It is certified that error appears in the above-identified patent and that said Letters Patent is hereby corrected as shown below:

COLUMN 1:

Line 28, "cleaning" should read --cleaning,--; and
Line 52, "sense" should read --direction--.

COLUMN 2:

Line 44, "of" should read --of:--; and
Line 65, "cross sectional" should read --cross-sectional--.

COLUMN 3:

Line 29, "of" (second occurrence) should be deleted; and
Line 39, "of" should be deleted.

UNITED STATES PATENT AND TRADEMARK OFFICE

CERTIFICATE OF CORRECTION

PATENT NO. : 5,633,702 Page 2 of 2

DATED : May 27, 1997

INVENTOR(S) : YASUKO HAYASHI, ET AL.

It is certified that error appears in the above-identified patent and that said Letters Patent is hereby corrected as shown below:

COLUMN 6:

Line 23, "respectively" should read --respectively,--; and
Line 26, "devices" should read --devices one--.

COLUMN 7:

Line 54, "form" should read --from--

Signed and Sealed this

Twenty-third Day of December, 1997

Bruce Lehman

*Attest:*

BRUCE LEHMAN

*Attesting Officer*

*Commissioner of Patents and Trademarks*